United States Patent [19]

Gaule

[11] Patent Number: 4,467,876

[45] Date of Patent: Aug. 28, 1984

[54] RIPPER TOOTH MEANS

[76] Inventor: Ronald L. Gaule, P.O. Box 294, North Liberty, Iowa 52317

[21] Appl. No.: 312,414

[22] Filed: Oct. 19, 1981

[51] Int. Cl.[3] ..... A01B 35/14

[52] U.S. Cl. ..... 172/870; 172/777; 37/2 R

[58] Field of Search ..... 172/777, 708, 713, 136, 172/197, 778; 37/2 R

[56] References Cited

U.S. PATENT DOCUMENTS

| | | | |
|---|---|---|---|
| 2,281,928 | 5/1942 | Fletcher | 172/777 |
| 2,302,702 | 11/1942 | Leschinsky | 172/197 |
| 2,384,957 | 9/1945 | Murphy | 172/778 |
| 2,566,547 | 9/1951 | Bartlett | 172/777 |
| 2,632,261 | 3/1953 | Ferris | 37/2 R |
| 2,634,520 | 4/1953 | Foster | 172/778 |
| 2,654,967 | 10/1953 | Small | 172/777 |
| 2,674,818 | 4/1954 | Carnes | 172/777 |
| 3,305,951 | 2/1967 | Nunn | 172/700 X |
| 4,085,530 | 4/1978 | Landry | 172/713 |
| 4,241,525 | 12/1980 | Mann | 172/777 |

*Primary Examiner*—Richard J. Johnson

*Attorney, Agent, or Firm*—Zarley, McKee, Thomte, Voorhees & Sease

[57] ABSTRACT

A ripper tooth means is disclosed in combination with a wheeled vehicle having a pair of forwardly extending arms, a frame secured to and extending between the arms, and a horizontal shaft removably mounted on the frame. The ripper tooth means is comprised of an elongated arm means having upper and lower ends and a longitudinal axis. A ripper tooth element is mounted on the lower end of the arm means. A sleeve element having a longitudinal axis extending at right angles to the longitudinal axis of the arm means is mounted on the upper end of the arm means. The sleeve element is slidably mounted on the horizontal shaft. A stop element is mounted on the sleeve element and is adapted to engage a portion of the frame upon limited rotational movement of the arm means with respect to the frame.

5 Claims, 5 Drawing Figures

RIPPER TOOTH MEANS

BACKGROUND OF THE INVENTION

Ripper tooth elements are a necessary part of certain construction machinery, for they are needed to rip and tear up hard ground materials, and are also used in a plurality of other situations, sometimes involving the breaking up of asphaltic or concrete layers. Most ripper tooth means are permanently attached to accessories for prime movers. They are often mounted at the rear of the vehicle and are usually never easily adaptable to the front end of any vehicle.

It is, therefore, a principal object of this invention to provide a ripper tooth means that can be easily attached to the forward end of a vehicle having a front end loader assembly.

A further object of this invention is to provide a ripper tooth means wherein a plurality of ripper tooth arms can be mounted on the forward end of a front end loader and the space therebetween easily adjusted.

A still further object of this invention is to provide a ripper tooth means mounted on the forward end of a front end loader wherein the pivotal movement of the ripper tooth arms is selectively limited with respect to the front end loader.

These and other objects will be apparent to those skilled in the art.

BRIEF SUMMARY OF THE INVENTION

The ripper tooth means of this invention is comprised of an elongated arm having upper and lower ends with a ripper tooth element on the lower end of the arm. A hollow sleeve element is mounted on the upper end of the arm and is disposed at a right angle with respect to the longitudinal axis of the arm. A stop element is mounted on the sleeve and is adapted to limit the rotational movement of the arm with respect to a front end loader upon which the arm is mounted.

The ripper tooth means of this invention is adapted to be mounted on the horizontal shaft of a frame extending between the forward ends of the arms of a conventional front end loader.

DESCRIPTION OF THE PREFERRED EMBODIMENT

Figure 1:
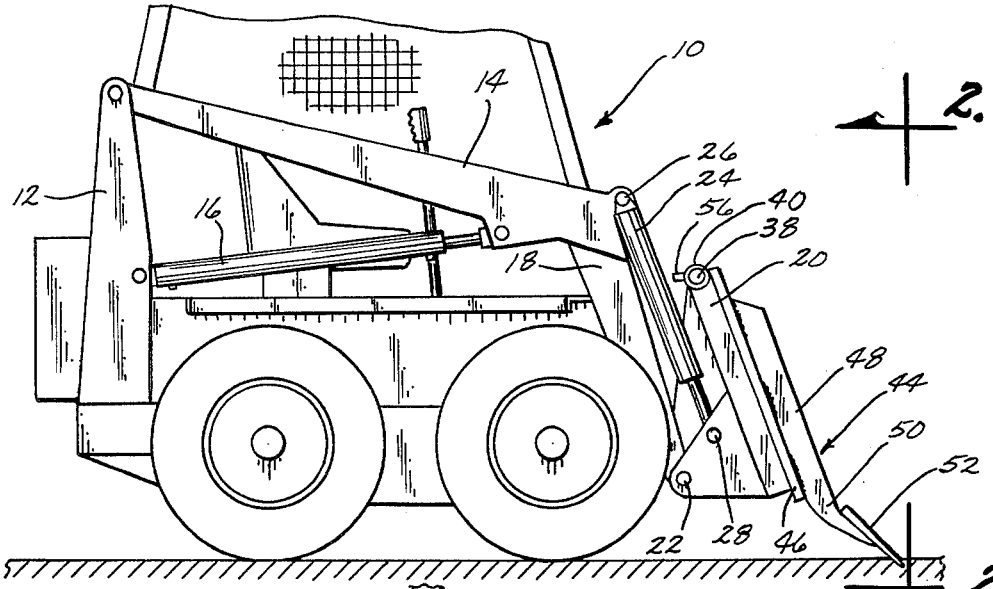
FIG. 1 is a side elevational view of a conventional front end loader with the ripper tooth means of this invention mounted on the forward end thereof.

A conventional front end loader 10 which is wheel mounted is best shown in FIG. 1. Loader 10 conventionally includes vertically disposed posts 12 at the rearward end thereof with forwardly extending arms 14 pivotally secured to the upper ends of post 12. Conventional cylinder 16 interconnects the midpoints of post 12 with the underside of arms 14 to raise and lower the same. Arm elements 18 extend forwardly and downwardly with respect to the forward ends of arms 14. A frame 20 extends between the forward ends of the arms 18 and is connected to the lower ends of arms 18 by pins 22. The pins 22 can be removed conventionally to separate the frame from the arms 18. Cylinders 24 have their upper ends pivotally secured to the forward ends of arms 14 by pins 26. The lower ends of the piston rods of cylinders 24 are pivotally secured to the frame 20 by pins 28. Pins 28 also can be conventionally removed when the frame is separated from the loader.

Frame 20 includes upper horizontal bar 32 and lower horizontal bar 34 which are interconnected by a plurality of vertical bars 36. A shaft 38 extends through a plurality of sleeves 40 which are welded or otherwise secured to the top of the upper bar 32. A pin 42 (FIG. 2) is inserted through a hole in shaft 38 so that the shaft can be selectively held within the sleeves 40 and can be selectively separated therefrom when the pin 42 is removed.

Figure 3:
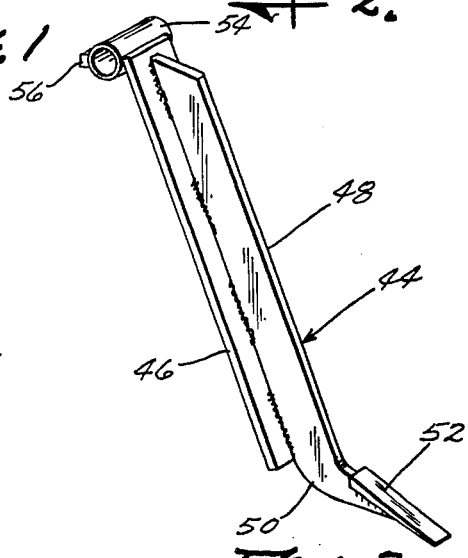
FIG. 3 is a perspective view of the ripper tooth means of this invention.

The ripper tooth means of this invention is comprised of arm 44 which is constructed of a stiffener plate 46 to which is welded elongated plate 48. As seen in FIG. 3, the arm 44 is T-shaped in cross-section. This results from plate 48 having one of its edges welded to the elongated axis of stiffener plate 46.

The lower end of plate 48 extends downwardly and outwardly from plate 46 to form tooth portion 50. A hardened tooth element 52 is then secured to tooth portion 50.

Figure 4:
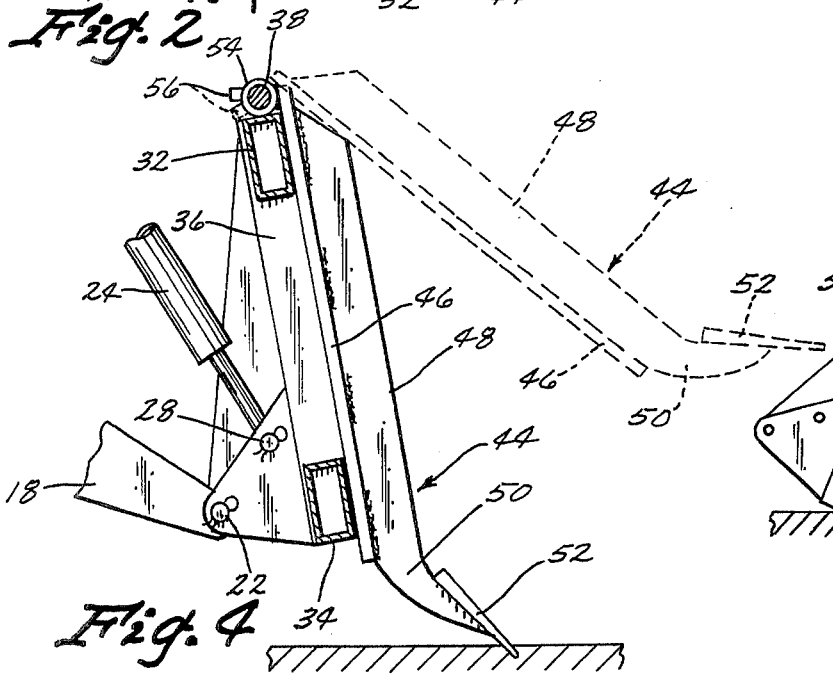
FIG. 4 is a sectional view taken on line 4—4 of FIG. 2.

A sleeve 54 is welded to the upper end of stiffener plate 46 so that the longitudinal axis of sleeve 54 extends in a direction perpendicular to the longitudinal axis of arm 44. A stop element 56 is welded to the back side of sleeve 54 in a direction directly opposite the top edge of stiffener plate 46. Sleeve 54 is substantially identical to the sleeves 40 and is adapted to be aligned with sleeves 40 with shaft 38 extending therethrough to rotatably mount the arm 44 on the frame 20. As indicated by the dotted lines in FIG. 4, the stop element permits the arm 44 to be rotated upwardly with respect to the frame approximately 30° before the stop element engages the upper bar 32.

Figure 2:
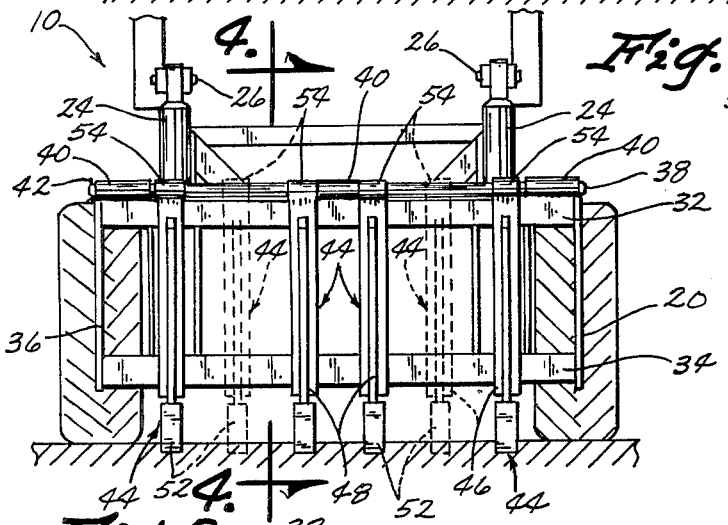
FIG. 2 is a partial front elevational view of the device of FIG. 1 as viewed from line 2—2 of FIG. 1.

A plurality of arms 44 are shown in FIG. 2, and they are all of identical construction. It should be noted that the arms 44 can be moved longitudinally on shaft 38 so that the spacing therebetween can be selectively varied.

It should be understood that the front end loader including the frame 20 is of conventional construction, and does not comprise a part of this invention apart from the ripper tooth means disclosed herein. The frame 20 is adapted to receive other working components for the front end loader. This invention utilizes this conventional frame 20 to support the ripper tooth means of this invention.

Any desired number of the arms 44 can be mounted on shaft 38 in the manner described above, and the spacing between the arms 44 can be adjusted as desired.

Since the arms 44 are not rigid with the frame, and are permitted some rotational movement with respect thereto, the stop element 56 is provided to limit the rotational movement of the arms with respect to the frame. Occasionally, during normal usage, a tooth element 52 on the lower end of one of the arms will suddenly disengage a rock or the like in its path and have a tendency to suddenly rotate upwardly. The stop element 56 limits this upper rotation to prevent this phenomenon from causing injury to any persons or the front end loader itself.

When the ripper tooth means of this invention are not needed, but if the frame 20 is to be needed in conjunction with the front end loader 10, the pin 42 is removed from shaft 38. The shaft 38 is then horizontally withdrawn from the sleeves 40 and 54 whereupon the arms 44 are separated from the frame 20. The shaft 38 is then reinserted in sleeves 40 and the frame is ready for other uses.

Figure 5:
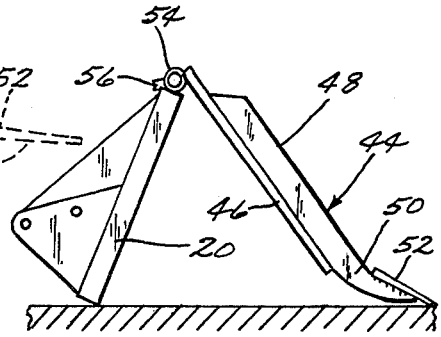
FIG. 5 is a side elevational view of the ripper tooth means and the frame means of the front end loader mounted in an inoperative stored position.

In those cases where the frame 20 is not needed, the pins 22 and 28 can be removed from arm elements 18 and cylinder 24, respectively, and the frame 20 and arms 44 can be stored in the position shown generally in FIG. 5.

From the foregoing, it is therefore seen that the device of this invention will achieve at least its stated objectives.

I claim:

1. In combination with a wheeled vehicle having a pair of forwardly extending arms, a frame secured to and extending between said arms, a horizontal shaft removably mounted on said frame, and a ripper tooth means, comprising, an elongated arm means having upper and lower ends and a longitudinal axis, a ripper tooth element on the lower end of said arm means, a sleeve element rigidly fixed to the upper end of said arm means, having a longitudinal axis extending at right angles to the longitudinal axis of said arm means, said sleeve element being laterally slidably mounted on said horizontal shaft, and said arm means normally resting against said frame and a stop element on the sleeve element of said arm means adapted to engage said frame after limited rotational movement of said arm means with respect to said frame.

2. The combination of claim 1 wherein a selectively variable plurality of said arm means are mounted on said horizontal shaft.

3. The combination of claim 1 wherein said ripper tooth element is disposed at an angle with respect to the longitudinal axis of said arm means.

4. The combination of claim 1 wherein said arm means is T-Shaped in cross-section and is comprised of two elongated perpendicularly disposed plates.

5. The combination of claim 1 wherein said frame and said arm means are normally disposed in an attitude downwardly and away from said vehicle.

* * * * *